United States Patent [19]

Marozzi

[11] Patent Number: 4,694,747

[45] Date of Patent: Sep. 22, 1987

[54] PRINT HEAD OPERATING MECHANISM

[76] Inventor: Alfred A. Marozzi, 3 Cheryl Rd., Pine Brook, N.J. 07058

[21] Appl. No.: 254,396

[22] Filed: Apr. 15, 1981

[51] Int. Cl.[4] ..... B41F 1/04

[52] U.S. Cl. ..... 101/301; 101/333; 101/360

[58] Field of Search ..... 101/103, 333, 310, 104, 101/108, 334, 335, 336, 298, 301, 359, 360, 324

[56] References Cited

U.S. PATENT DOCUMENTS 3,241,482 3/1966 Keck ..... 101/333 X 3,797,390 3/1974 Marozzi et al. ..... 101/333

3,804,016 4/1974 Marozzi et al. ..... 101/333

4,052,938 10/1977 Kirby ..... 101/333 X

*Primary Examiner*—Edgar S. Burr

*Assistant Examiner*—Moshe I. Cohen

*Attorney, Agent, or Firm*—Harvey B. Jacobson

[57] ABSTRACT

Travel of a printing head between ink-receiving and marking positions is guided along an arcuate path by a fluid power piston device having a cylinder pivotally mounted at its forward end on the frame of the printing apparatus. The longitudinal axis of the ink storing cartridge engaged by the printing head in the ink-receiving positions, is inclined downwardly and is tangent to the travel path at the adjacent terminal end thereof.

11 Claims, 12 Drawing Figures

7°
72
68
50
56
28
54
30
44
70
58
62
66
24
22
18
20
60
50
48
28
32
30
12
42
53
36
54
14
16
56
62

PRINT HEAD OPERATING MECHANISM

BACKGROUND OF THE INVENTION

This invention relates to the imprinting on or marking of moving surfaces of material such as packaging webs, by apparatus of the type disclosed in my prior U.S. Pat. Nos. 3,797,390 and 3,804,016.

The foregoing type of imprinting apparatus involves displacement of a printing head independently of an ink storing cartridge between a horizontal ink-receiving position engaging an ink pad in the forward end of the ink storing cartridge and a vertical marking position engaging a horizontal marking surface. A fluid power operating device is utilized to effect such displacement of the printing head through a mechanism that reorientates the printing head for proper contact with the ink pad in the cartridge and the marking surfaces at opposite ends of a stroke along a direction-changing path of travel. The cylinder of the fluid power operating device is fixedly mounted on the apparatus frame alongside of the cartridge and travel of the printing head is controlled by guide slots in side plates between which the printing head is carried by a holder mounting a pivot shaft supporting guide rollers engaged within the guide slots.

The foregoing arrangement is such as to limit the speed of the marking operation and to impose minimal size limitations on the construction of the apparatus.

It is therefore an important object of the present invention to provide an improved imprinting apparatus of reduced size and weight and having a faster operational capability.

SUMMARY OF THE INVENTION

In accordance with the present invention, travel of the printing head is guided along a travel path by arcuate slots in the side plates, having opposite terminal ends that lie on tangents to the art and intersect on a fixed pivot axis about which the printing head is pivoted in response to its travel in order to properly orientate it for contact in the ink-receiving and marking positions. The piston rod of the power operating device is pivotally connected to the printing head at a movable pivot axis displaced along the travel path established by the guide slots. The power cylinder from which the piston rod extends, is pivotally mounted on the frame at its forward end.

The aforementioned tangent to the travel path at one terminal end adjacent the ink storing cartridge, is coincident with the longitudinal axis of the cartridge. Further, the cartridge is mounted on the frame so that its fixed longitudinal axis is inclined downwardly from its forward ink-transferring end by approximately 7° to avoid gravitational accumulation of excess ink at said forward end and thereby eliminate drippage from such accumulations.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 7:
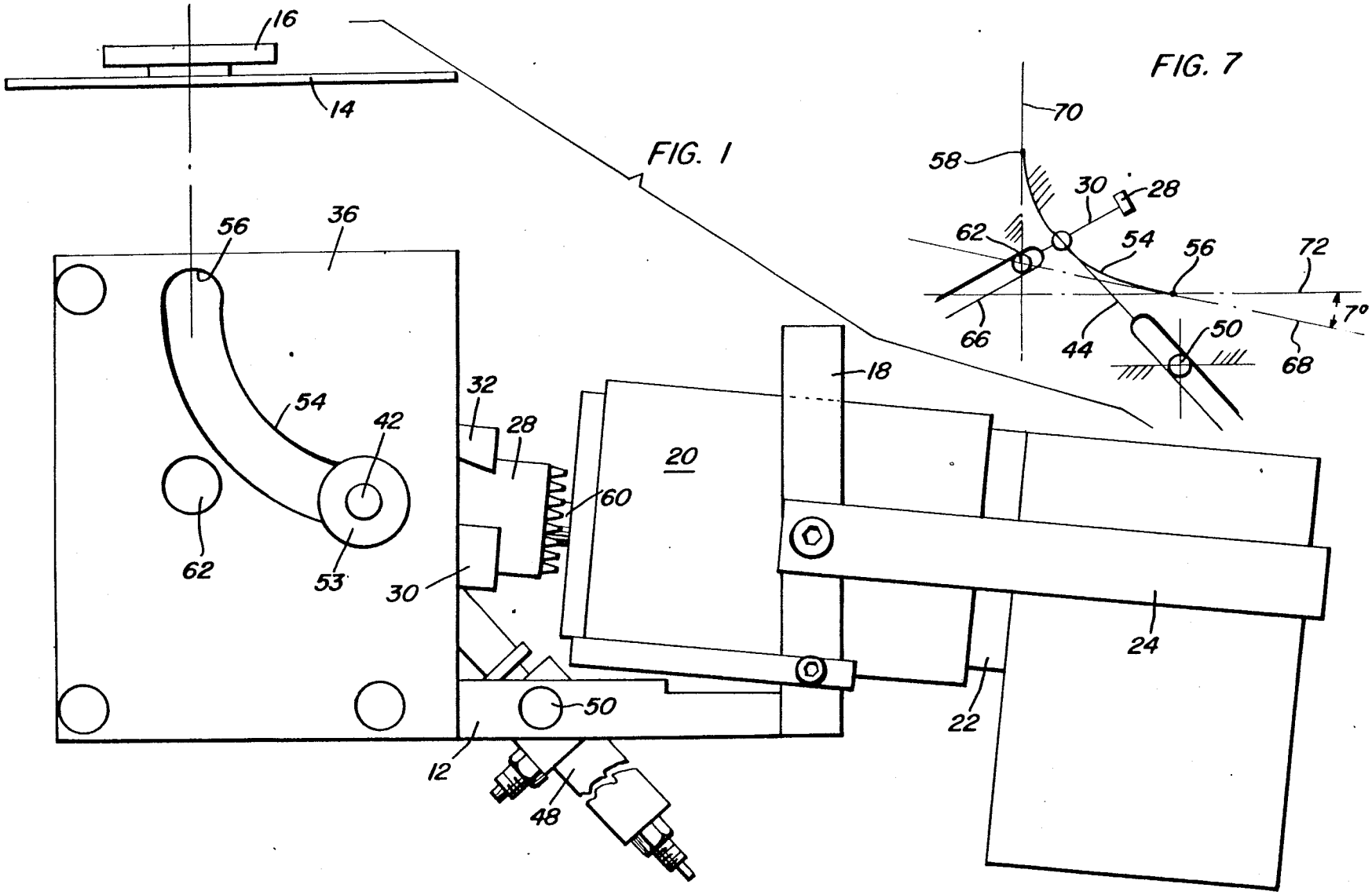
FIG. 1 is a side elevational view of the printing apparatus in accordance with one embodiment of the invention.
FIG. 7 is a kinematic representation of the geometrical arrangement associated with the apparatus of FIGS. 1–6.
Figure 3:
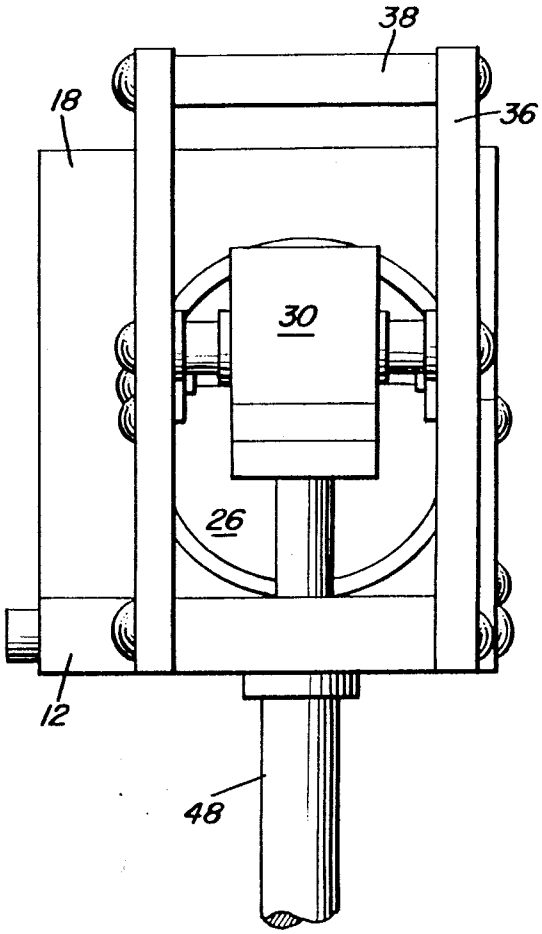
FIG. 3 is a front elevational view of the apparatus shown in FIGS. 1 and 2.
Figure 2:
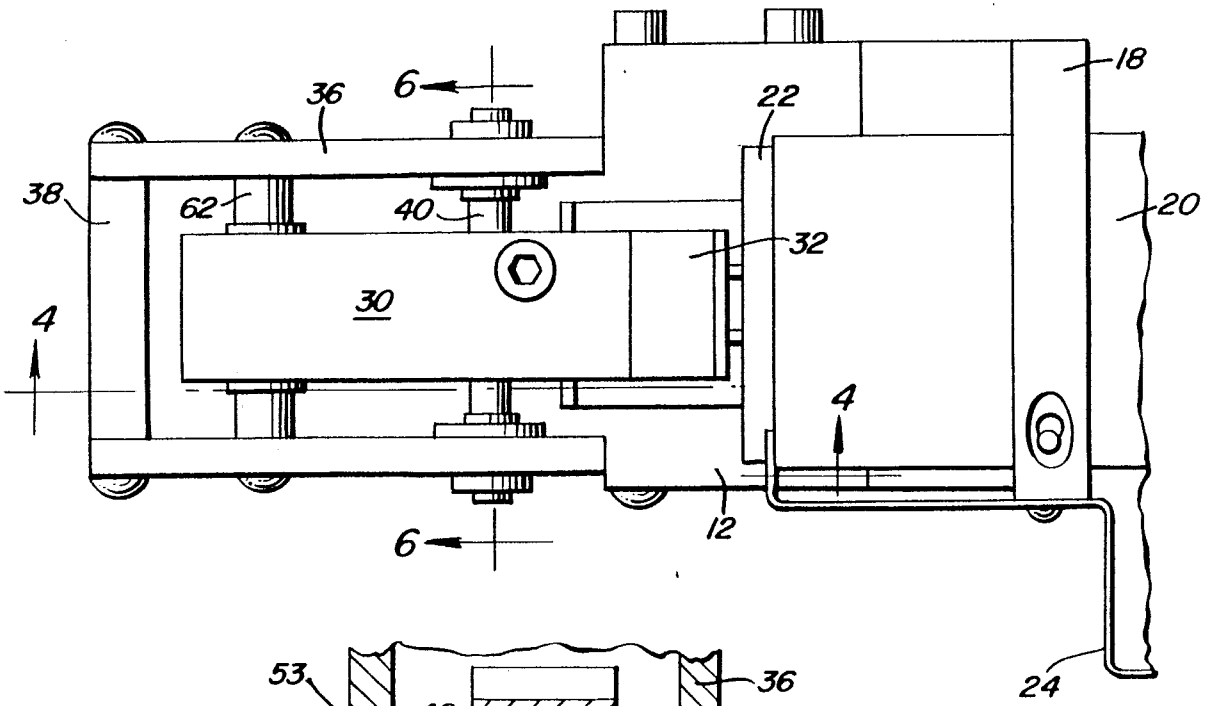
FIG. 2 is a partial top plan view of the apparatus shown in FIG. 1.
Figure 4:
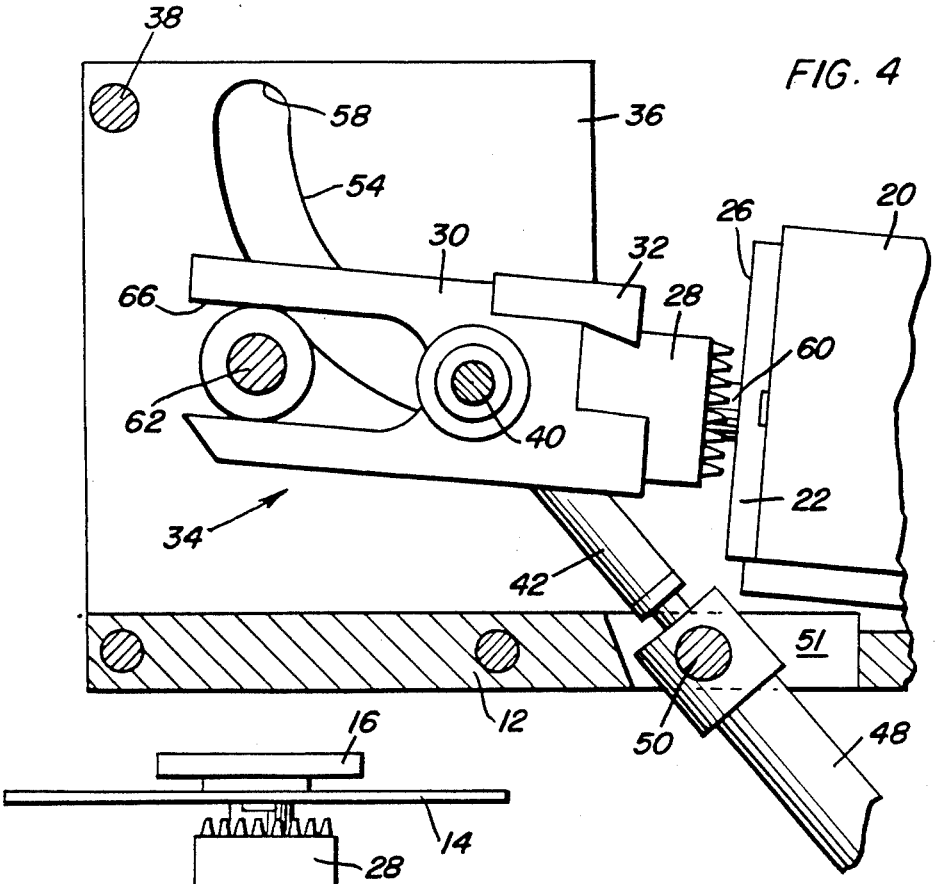
FIG. 4 is a partial side sectional view taken substantially through a plane indicated by section line 4—4 in FIG. 2, showing the apparatus in an ink-receiving operational phase.
Figure 5:
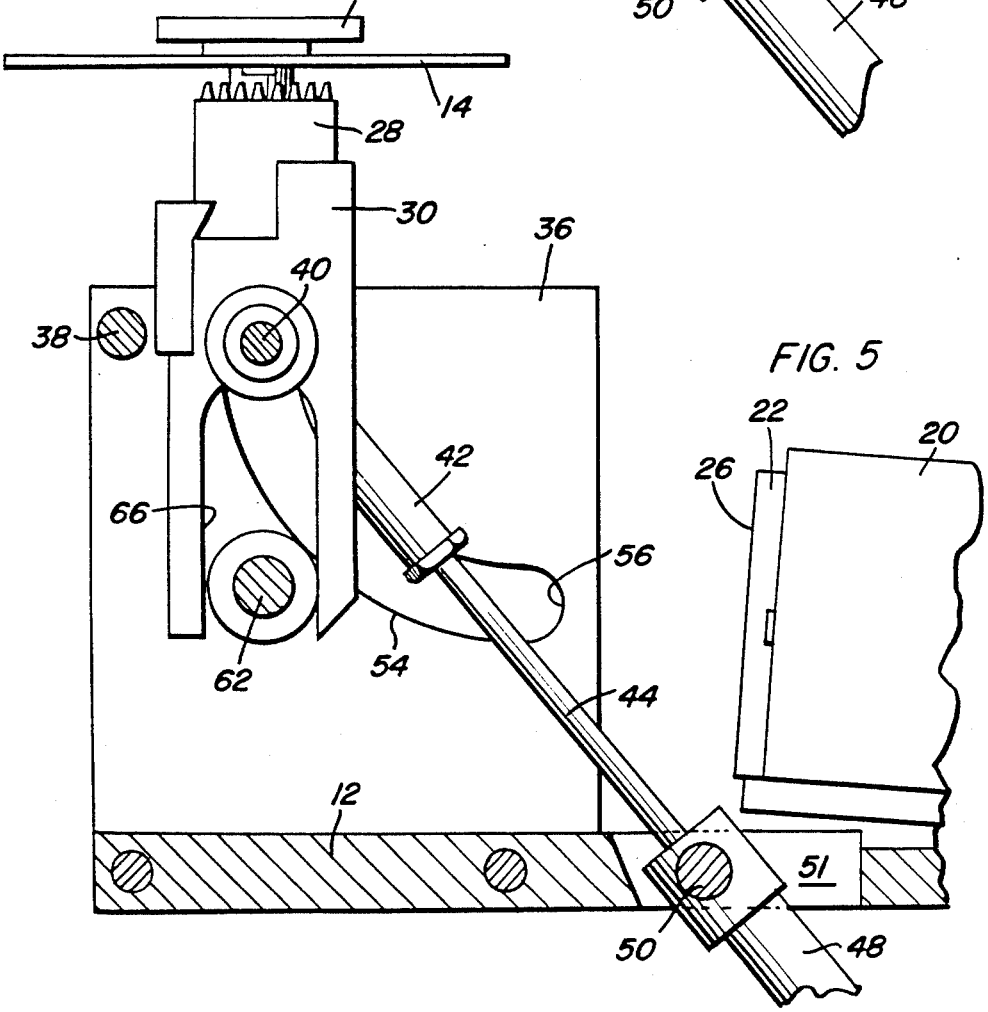
FIG. 5 is a partial sectional view similar to FIG. 4, but showing the apparatus in a marking phase of operation.
Figure 9:
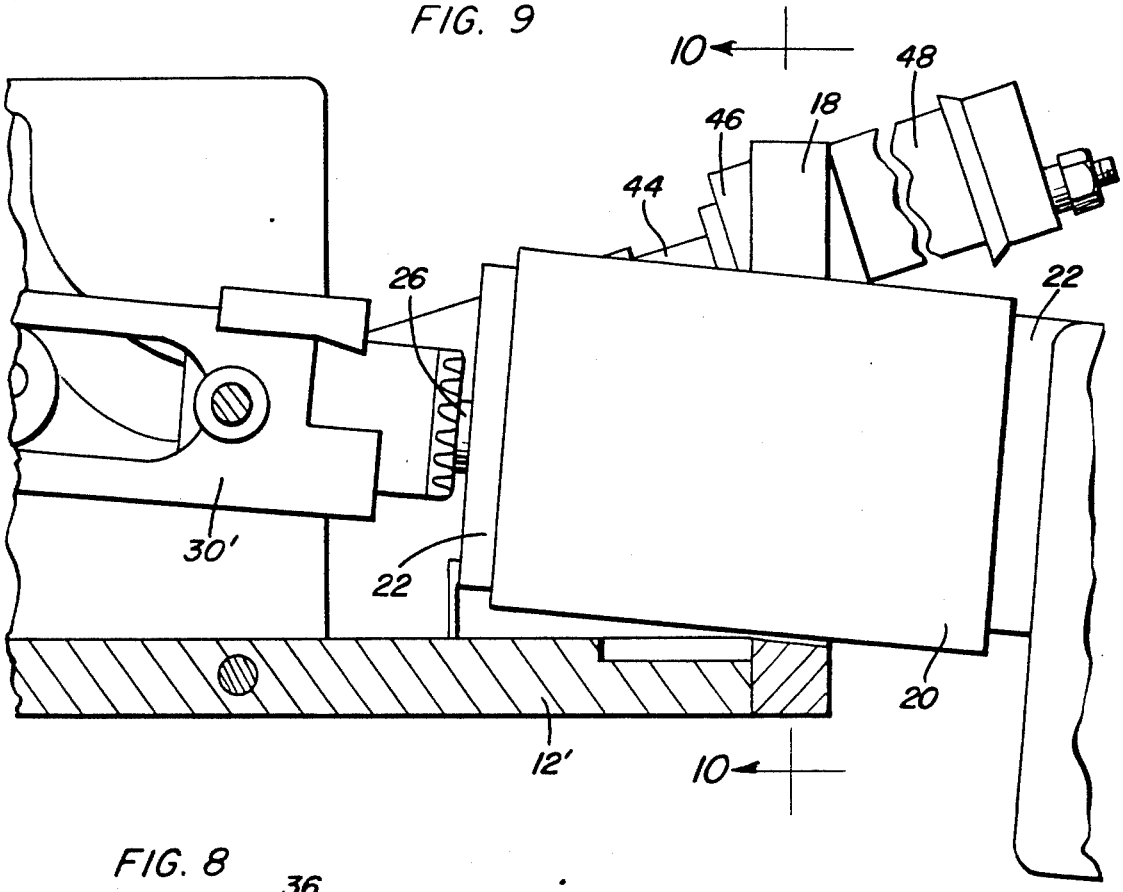
FIG. 9 is a side sectional view taken substantially through a plane indicated by section line 9—9 in FIG. 8.
Figure 8:
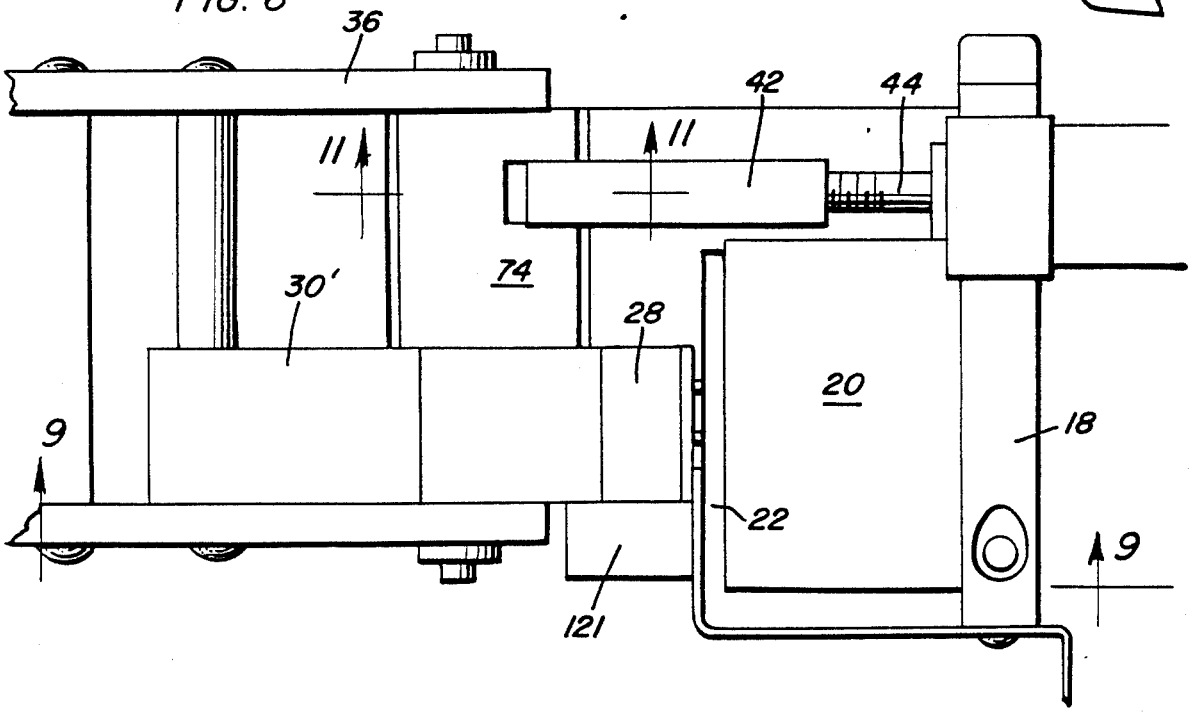
FIG. 8 is a partial top plan view of a printing apparatus in accordance with another embodiment of the invention.
Figure 10:
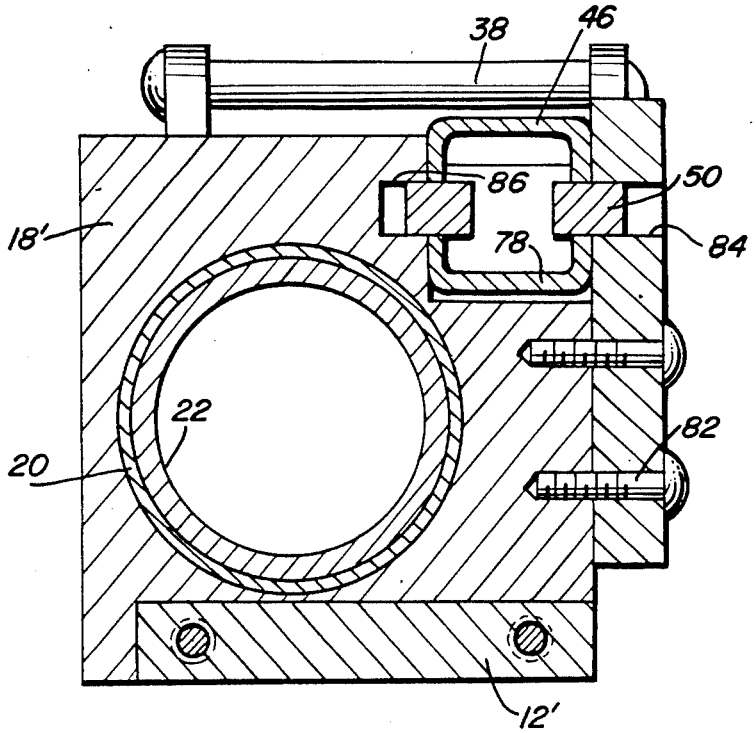
FIG. 10 is a transverse sectional view taken substantially through a plane indicated by section line 10—10 in FIG. 9.
Figure 11:
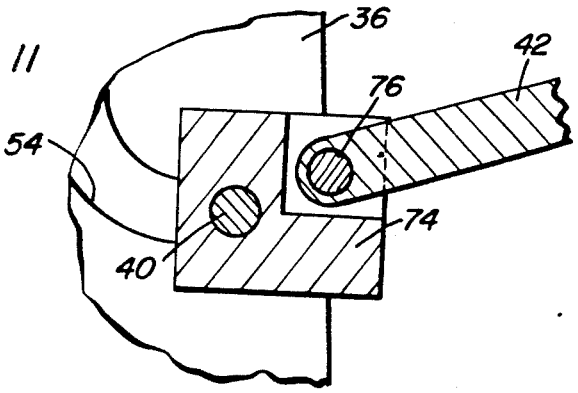
FIG. 11 is a partial sectional view taken substantially through a plane indicated by section line 11—11 in FIG. 8.

Referring now to the drawings in detail, FIGS. 1, 2 and 3 illustrate one embodiment of the invention associated with an imprinting apparatus, generally referred to by reference numeral 10. The apparatus is supported on a horizontal surface by means of a frame having a base plate portion 12 in order to imprint or mark a moving planar surface on a web 14, for example. The web is positioned above the apparatus and is backed by a platen 16 through which the surface to be imprinted is maintained horizontal or parallel to the supporting surface on which the base 12 rests. One end of the base portion of the frame, has a sleeve holder 18 fixed thereto supporting a cartridge mounting sleeve 20 through which an ink storing cartridge 22 extends. The cartridge is urged forwardly by a spring clip 27 mounted on the holder 18 in order to accommodate limited rearward displacement of the cartridge when an ink pad therein is engaged at the ink-transferring end portion 26 by a print head 28. The print head is carried by a holder body 30 to which it is locked by a keeper 32 and is displaced between an ink-receiving position as shown in FIGS. 1, 2 and 4 and a marking position as shown in FIG. 5, by a power operated mechanism generally referred to by reference numeral 34 as more clearly seen in FIGS. 4 and 5. The mechanism 34 is located between a pair of parallel spaced side plates 36 secured to the base portion 12 in spaced relation to the cartridge holder 18. Tie rod 38 maintains the spacing between side plates 36 above the base portion 12. Except for certain improvements in the relative orientation of the cartridge and the details of the mechanism 34, the foregoing arrangement of the apparatus 10 is similar to that disclosed in my prior U.S. Pat. No. 3,804,016, aforementioned.

Figure 6:
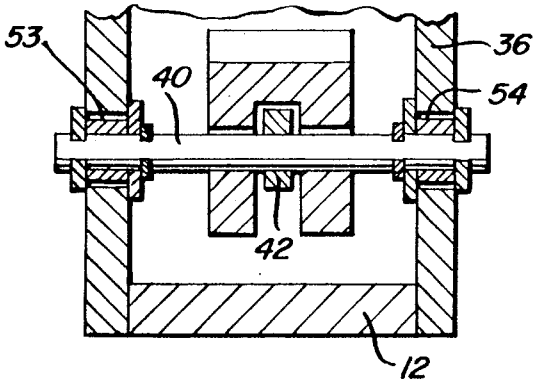
FIG. 6 is a partial transverse sectional view taken substantially through a plane indicated by section line 6—6 in FIG. 2.

The print head displacing and orientating mechanism 34 includes a pivot shaft 40 through which the print head holder body 30 is pivotally connected at a movable pivot axis to the clevis end 42 of a piston rod 44. The piston rod extends from the front end block portion 46 of a fluid power housing or cylinder 48 pivotally mounted by pivot trunnions 50 on the frame within a slot 51 formed in the base portion for such purpose. In the embodiment shown, pivot shaft 40 pivotally interconnects the piston rod clevis 42 and the print head body 30 as more clearly seen in FIG. 6 as well as to mount side flanged roller assemblies 53 at opposite axial ends of the shaft. The roller assemblies 53 are engaged in arcuate guide slots 54 formed in the side plates 36 so as to establish a travel path along which the print head is displaced at the pivot axis of pivot shaft 40. The guide slots 54 have a continuous smooth curvature such as the arc of a circle with opposite terminal ends 56 and 58 limiting movement of the print head between its ink-receiving and marking positions in response to slidable extension and retraction of the piston rod 44 relative to the pivotally mounted fluid power cylinder 48.

The mechanism 34 includes means for orientating the contact surface 60 of the print head in the ink-receiving and marking positions so as to be parallel to the ink transferring end portion 26 and the planar marking surface on web 14. Such orientating means includes a bearing shaft 62 fixedly mounted on the frame between the side plates 36. A bearing roller 64 mounted on the shaft 62 is received in a guide slot 66 formed in the print head holder body 30 as shown in FIGS. 4 and 5 so as to constrain pivotal displacement of the print head about the movable pivot axis through pivot shaft 40 during movement thereof along the arcuate path of fixed guide slots 54.

Proper orientation of the print head is assured by alignment of the fixed axis through bearing shaft 62 with the terminal ends 56 and 58 of the guide slots 54 on tangents respectively coincident with the longitudinal axis 68 of the ink storing cartridge 22 and a perpendicular 70 to the surface on web 14. The movable pivot axis through pivot shaft 40 will therefore lie on the tangents 68 and 70 when shaft 40 is at the terminal ends of the guide slots 54 as shown in FIGS. 4 and 5. By making the curvature of the slots 54 tangent at the terminal ends, smooth movement of the print head between the ink-receiving and marking positions is assured as well as proper orientation of its contact surface 60.

FIG. 7 is a kinematic representation more clearly showing the geometric relationship associated with the mechanism 34 herein described. It will be observed from FIG. 7 that the axis 68 of the cartridge extending tangentially to the arcuate path of slots 54 at the terminal end 56, is at an acute angle of 7° to the horizontal line 72 parallel to the planar marking surface and perpendicular to tangent line 70. The angular disposition of axis 68 is reflected by a downward inclination of the cartridge 22 rearwardly from its ink-transferring end 26 as seen in FIG. 1. Such inclination of the cartridge 22 from the horizontal will avoid the presence of excess ink at end 26 and eliminate drippage.

Figure 12:
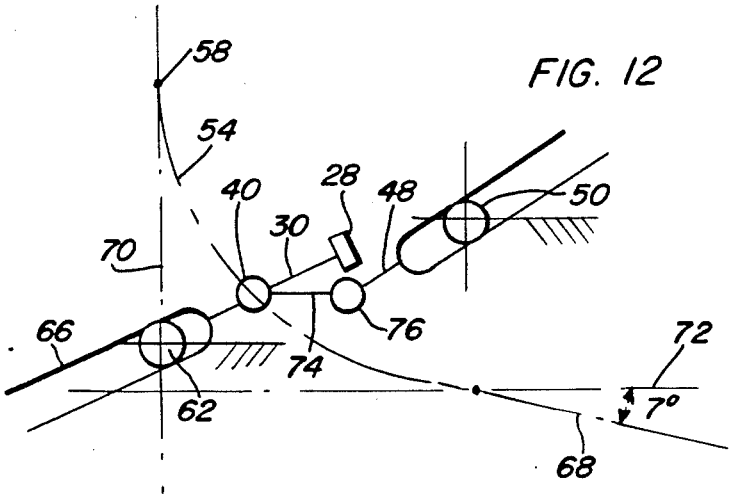
FIG. 12 is a kinematic representation of the arrangement shown in FIGS. 8–11.

In the arrangement of FIGS. 1–7, the power operating device is aligned below the print head holder body 30, with the trunnions 50 mounted in the base portion 12. According to the arrangement of FIGS. 8–12, the power operating device is laterally spaced from the cartridge 22 and is pivotally connected to the holder body 30' through a lateral extension 74. The piston rod clevis 42 is pivotally connected by a pivot pin 76 to extension 74 closely spaced from the pivot shaft 40 as more clearly seen in FIG. 11. Further, the power cylinder 48 is pivotally mounted by the trunnions 50 in the sleeve holder 18' above the print head. A corner recess 78 is therefore formed in the holder 18' as more clearly seen in FIG. 10 to receive the front end block 46 of the power cylinder. A closure plate 80 is secured by fasteners 82 to the holder 18' to hold the cylinder assembled in recess 78 and is provided with a bore 84 aligned with bore 86 in the holder to receive the trunnions 50. The construction of the apparatus as shown in FIGS. 8–11 is otherwise the same as that of FIGS. 1–6. The operation is also similar except for the kinematic differences apparent from a comparison of FIGS. 7 and 12. In both cases, the same travel and reorientation of the print head occurs between a horizontal marking surface and the inking end of an inclined cartridge.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In an apparatus for intermittently marking a substantially horizontal surface, including a frame, an elongated ink storing cartridge having a longitudinal axis, an ink transferring end portion and an ink pad at said end portion with a surface substantially perpendicular to the axis, a print head movably mounted on the frame independently of the cartridge, and a power operated mechanism connected to the print head for displacement thereof between marking and inking positions respectively engaging the horizontal surface and the surface of the ink pad at the ink transferring end portion of the cartridge, the improvement comprising means for mounting the cartridge on the frame in an inclined position extending downwardly from the ink pad surface at the ink transferring end portion with the axis thereof fixed at an acute angle to the horizontal surface.

2. The combination of claim 1 wherein said mechanism includes means for guiding movement of the print head along an arcuate path of continuous curvature having a terminal end corresponding to the inking position at which the path is substantially tangent to said fixed axis of the cartridge.

3. The combination of claim 2 wherein said mechanism further includes an elongated holder on which the print head is fixedly mounted, a power operating device, means pivotally connecting the power operating device to the holder at a movable pivot axis constrained to movement along said path by the guiding means, and bearing means engageable with the holder for constraining displacement thereof about the movable pivot axis to orientate the print head in the marking position thereof.

4. The combination of claim 3 wherein said bearing means includes a guide element engageable with the holder at a fixed pivot axis, said arcuate path having a second terminal end corresponding to the marking position of the print head aligned with the fixed pivot axis along a tangent to the path, said tangent being substantially perpendicular to the horizontal surface.

5. The combination of claim 4 wherein said power operating device includes an elongated rod pivotally connected to the holder at said movable pivot axis by the pivotal connecting means, a power housing from which the rod slidably extends, and means pivotally mounting said power housing on the frame.

6. The combination of claim 1 wherein said mechanism includes means for guiding movement of the print head along an arcuate path having a terminal end corresponding to the inking position at which the path is substantially tangent to said axis of the cartridge, bearing means engageable with the print head at a pivot axis fixed to the frame and a power operating device pivotally connected to the print head for displacement thereof along the arcuate path between said first mentioned terminal end and an opposite terminal end aligned with the fixed pivot axis along a tangent to the path substantially perpendicular to the horizontal surface.

7. The combination of claim 6 wherein said power operating device includes an elongated rod pivotally connected to the print head, a power housing from which the rod slidably extends, and means pivotally mounting said power housing on the frame.

8. The combination of claim 7 wherein said rod is pivotally connected to the print head at a point on the arcuate path.

9. The combination of claim 8 wherein said rod is pivotally connected to the print head in laterally spaced relation to the cartridge.

10. In an apparatus for intermittently marking a substantially planar surface, including a frame, an elongated ink storage cartridge having an inclined longitudinal axis, an ink transferring end portion and an ink pad at said end portion with a surface substantially perpendicular to the axis, a print head mounted on the frame for movement independently of the cartridge, and a power operated device pivotally connected to the print head at a movable pivot for displacement thereof between marking and inking positions respectively engaging the planar surface and the surface of the ink pad in the end portion of the cartridge, the improvement comprising means mounting the cartridge on the frame for fixing said inclined axis thereof to the frame, means for guiding movement of the movable pivot along an arcuate path having a substantially constant radius of curvature and opposite terminal ends, and orienting means engageable with the print head at a second pivot fixed to the frame for angularly displacing the print head about said movable pivot in response to said movement along the arcuate path between said inking and marking positions, said opposite terminal ends of the arcuate path lying on tangents thereto which intersect at the fixed pivot, one of the said tangents being coincident with the fixed inclined longitudinal axis of the cartridge.

11. The combination of claim 10 wherein said print head has a contact surface orientated parallel to the ink pad in the end portion of the cartridge and the planar marking surface in the respective inking and marking positions, the inclined longitudinal axis tangent to one of the terminal ends of the arcuatte path extending at an acute angle of approximately 7° to the planar surface.

* * * * *